US006983938B2

(12) United States Patent
Goldsmith

(10) Patent No.: US 6,983,938 B2
(45) Date of Patent: Jan. 10, 2006

(54) RAPID FIRE RESETTING TARGET

(76) Inventor: David Christopher Goldsmith, 9180 Sadie La., LaPlata, MD (US) 20646

( * ) Notice: Subject to any disclaimer, the term of this patent is extended or adjusted under 35 U.S.C. 154(b) by 0 days.

(21) Appl. No.: 10/409,085

(22) Filed: Apr. 9, 2003

(65) Prior Publication Data

US 2004/0201172 A1 Oct. 14, 2004

(51) Int. Cl.
*F41J 7/84* (2006.01)

(52) U.S. Cl. ..... 273/391

(58) Field of Classification Search ..... 273/390–392, 273/406, 407, 388
See application file for complete search history.

(56) References Cited

U.S. PATENT DOCUMENTS 3,844,559 A * 10/1974 Davidson et al. ..... 273/391
4,949,980 A * 8/1990 Hoy ..... 273/391

* cited by examiner

*Primary Examiner*—Mark S. Graham

(57) ABSTRACT

An impact target having a frame that houses and supports knockdown targets with each knockdown target having its own reset target. Knockdown targets are positioned having the target rest on top of the frame. The knockdown target is protected inside of the frame. Once the knockdown target is hit a bullet it swings back and down in a vertical position inside of the frame. Reset targets are positioned horizontally with the target positioned in front of the frame; the reset target is positioned to slide through the face of the frame once a bullet hits it. The impact by the bullet on the reset target will then transfer its energy to its knockdown target returning it to its resting position on top of the frame. Therefore, a bullet has hit the reset target.

1 Claim, 6 Drawing Sheets

13
12
14
26
13
14
26
24
25
11
17
12
16
18
15
16
18
15
22

RAPID FIRE RESETTING TARGET

BACKGROUND OF THE INVENTION

The Rapid Fire Resetting Target relates to the target shooting sport. More specifically, to the automatic resetting target systems used in the shooting field. There are patents of resetting targets, each having a single mechanism to reset a plurality of knockdown target. Other patents use different types of linkage to reset their targets. The Rapid Fire Resetting Target uses a reset target for each knockdown target, with no linkage or other complicated mechanism to reset the knockdown target. Thus simplifying the automatic resetting target system.

BRIEF SUMMARY OF THE INVENTION

The objective of the Rapid Fire Resetting Target is to give target shooters an automatic resetting target apparatus that is reliable and simplistic in design, giving shooters fewer parts to maintain. The lightweight compact design, gives shooters a portable resetting target that is easy to transport and set up at a shooting range. Affordable via a simple and compact design making this resetting target available to more shooters of varying incomes.

Another objective is to provide a resetting target, that is not dependent on a single reset mechanism, and is versatile enough to be used for rapid, and slow fire. The target apparatus may also be used in any of the preferred shooting positions, and varying distances, making this invention as challenging as the shooter prefers.

BRIEF DESCRIPTION OF DRAWING

Figure one is a top perspective view of my Rapid Fire Resetting Target

Figure two is an end view thereof

Figure three a top plan view taken along lines 3—3 of figure two

Figure four is a cross-section taken along lines 4—4 of figure three showing a sequence of the top target being hit Figure five is a view similar to figure four with the top target down Figure six is a view similar to figure four showing a sequence of the bottom target being hit and thereby resetting the top target

DETAILED DESCRIPTION OF THE RAPID FIRE RESETTING TARGET

Figure 1:
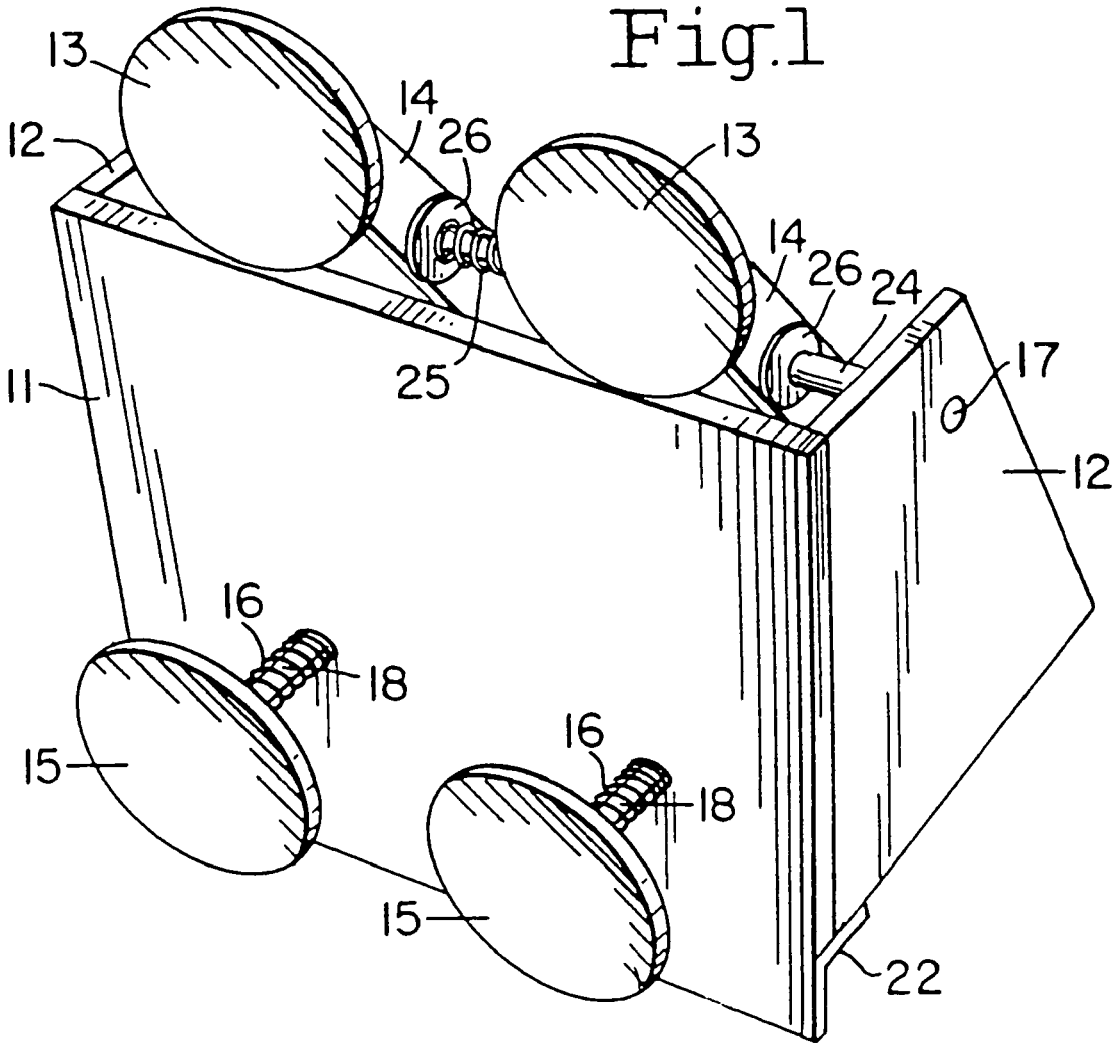

FIG. 1 is a top prospective view showing face plate 11 in a vertical upright position. Side plates 12 are attached to the inside edge of face plate 11 by welding or other secure attachment so as to make the frame for the Rapid Fire Resetting Target. Knockdown targets 13 rest on top of faceplate 11 ,and said knockdown targets 13 are attached to stem 14 by welding or other secure means of attachment. Side plates 12 have a hole drilled slightly larger than shaft 17. Where as shaft 17 extends though side plates 12. Stems 14 are drilled through to allow said stem 14 to pivot freely onto shaft 17. Reset targets 15 are positioned in front of face plate 11, and held in position by threaded rod 18 and reset spring 16. Reset targets 15 are welded or secured by other means of attachment to threaded rod 18.

Figure 2:
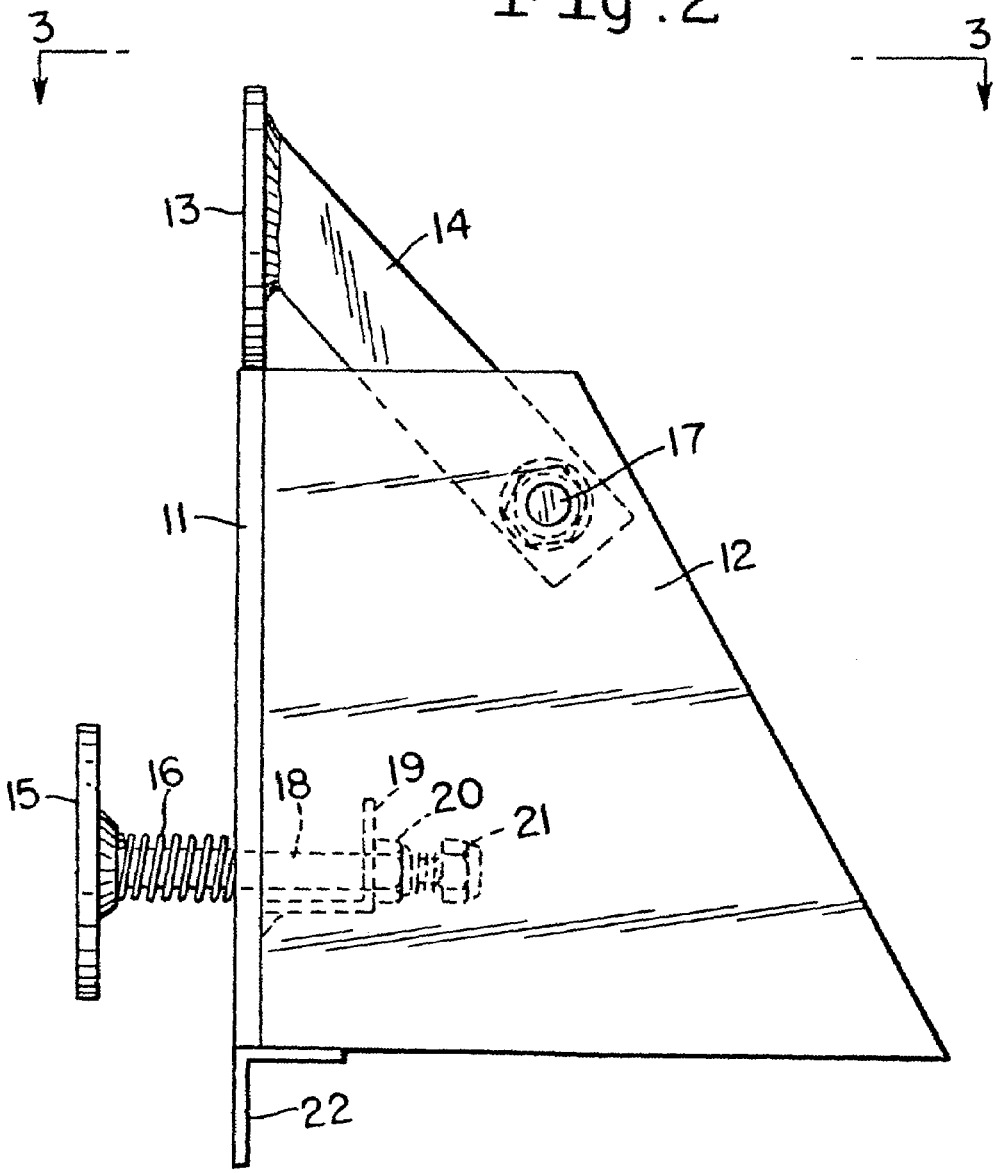

FIG. 2 is an end view thereof with knockdown target 13 resetting on top of face plate 11. A cut away view of stem 14 illustrates the angle of attachment to shaft 17. Knockdown target 13 is in its normal position before being hit by a bullet or other projectile. Threaded rod 18 is inserted through a hole drilled through face plate 11, the hole in said face plate 11 is slightly larger then said threaded rod 18, so as to allow free movement of said threaded rod 18. Reset target 15 is in the normal position before being hit by a bullet or other projectile. Support angle 19 extends the whole length of face plate 11 to side plates 12. Support angle 19 is welded or attached by other secure means to said face plate 11 and said side plate 12. Supports angle 19 is drilled and positioned so as to allow threaded rod 18 to extend through freely. Stop nut 20 comes into contact with support angle 19 to apply slight tension onto reset spring 16. Contact nut 21 is threaded onto the end of threaded rod 18 to form an adjustable contact surface for stem 14. Angle stop 22 is welded or attached by other means to the bottom edge of face plate 11 and the bottom edge of side plate 12 so as to be placed over the edge of a table or other type of support.

Figure 3:
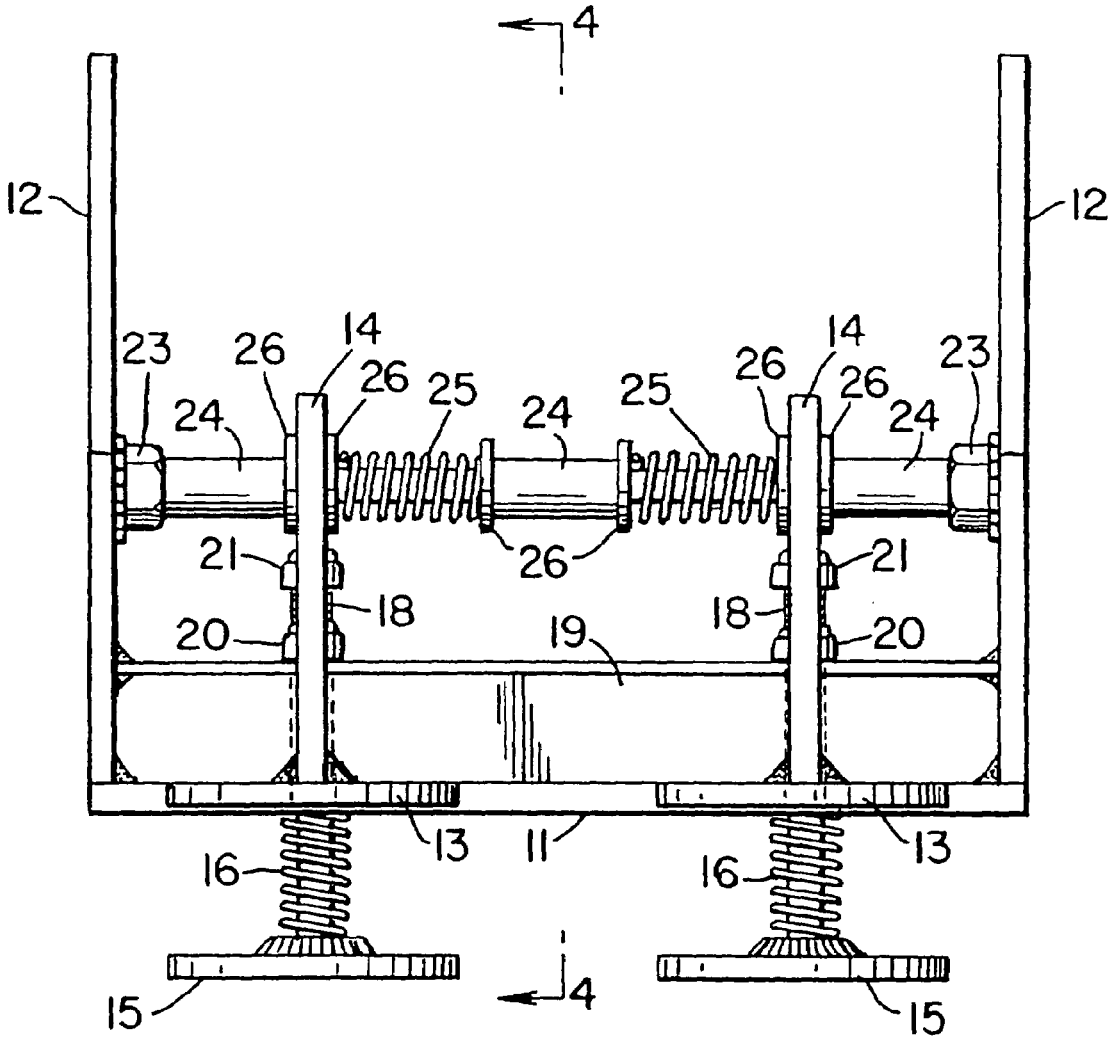

FIG. 3 a top plan view taken along lines 3—3 of FIG. 2 illustrates target stem 14 in vertical alignment with thread rod 18. Target stem 14 is positioned on shaft 17 so that knockdown target 13 will clear side plate 12 when said knockdown target 13 is hit with a bullet or other projectile. Shaft 17 is secured to side plates 12 with nuts 23 or other secure means. Spacers 24 are placed along shaft 17 so that compression springs 25 force washers 26 and stems 14 towards nuts 23 holding said stem 14 in alignment with threaded rod 18.

Figure 4:
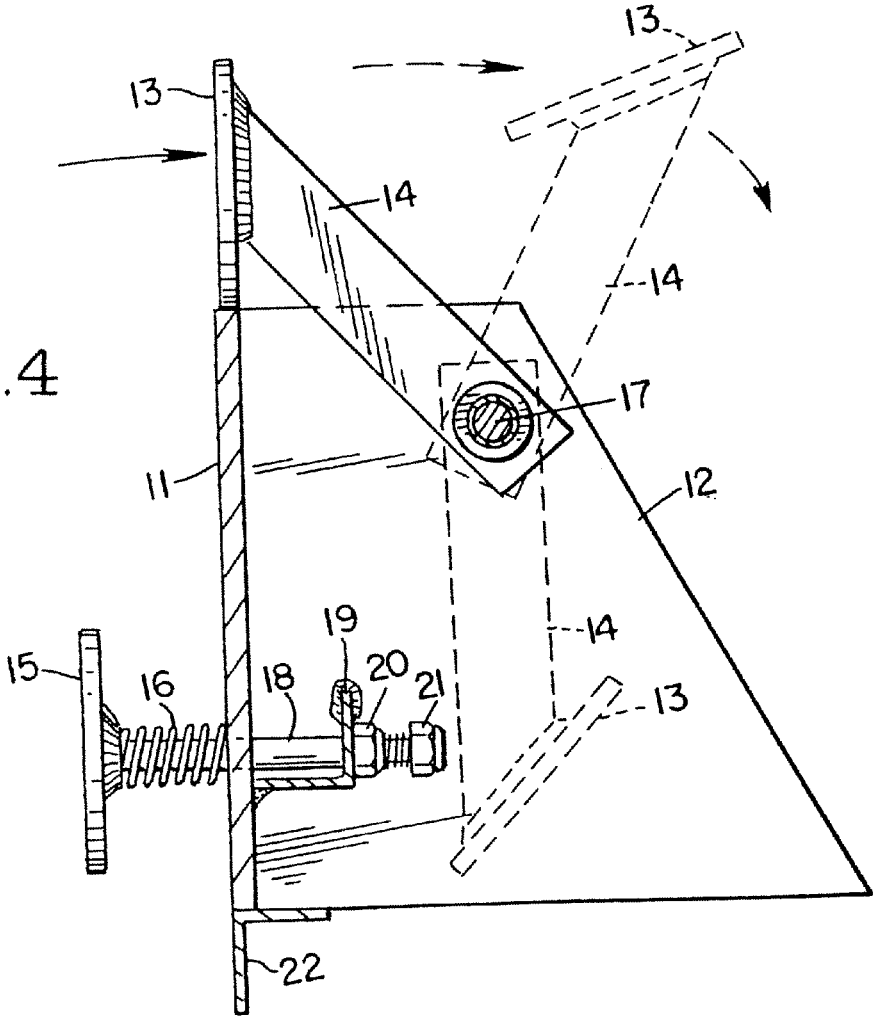

FIG. 4 is a cross section taken along 4—4 of FIG. 3 showing a cross sequence of the knockdown target 13 being hit by a bullet or other projectile. Knockdown target 13 when hit by a bullet or projectile is forced backwards and down behind faceplate 11 out of view of the shooter. Stem 14 pivots on shaft 17 until coming to rest in a vertical position slightly touching contact nut 21.

Figure 5:
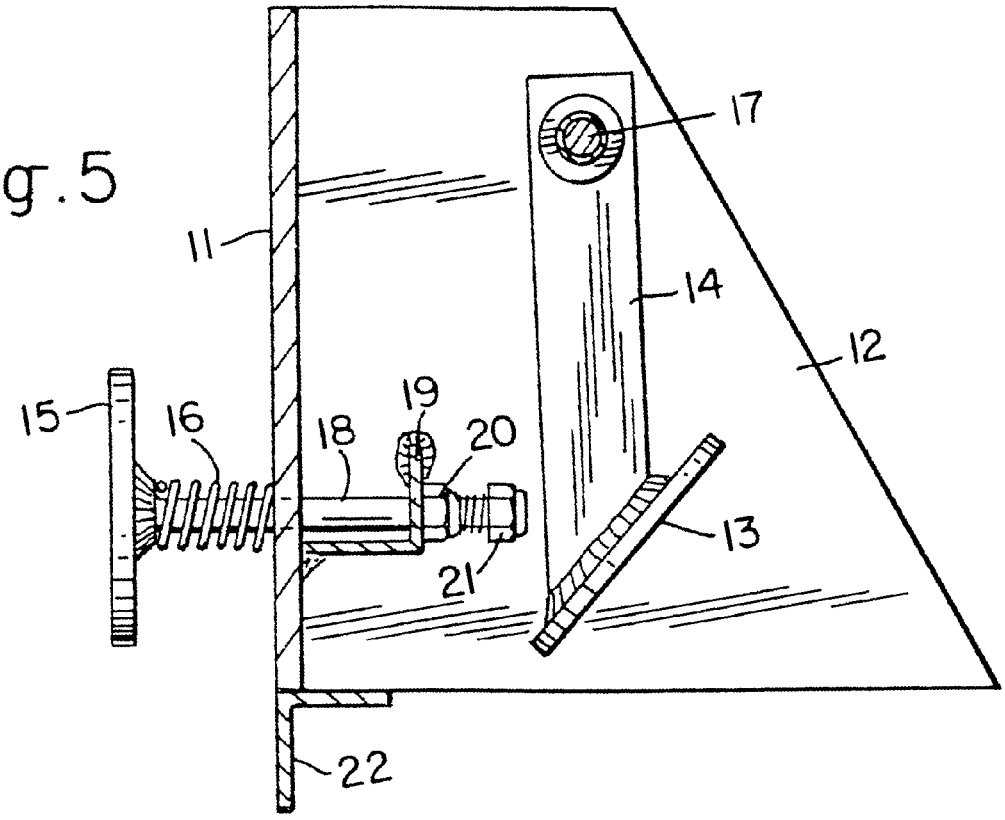

FIG. 5 is a view similar to FIG. 4 with the knockdown target 13 at rest after being hit by a bullet or projectile. Reset target 15 is in its normal position before being hit by a bullet or projectile.

Figure 6:
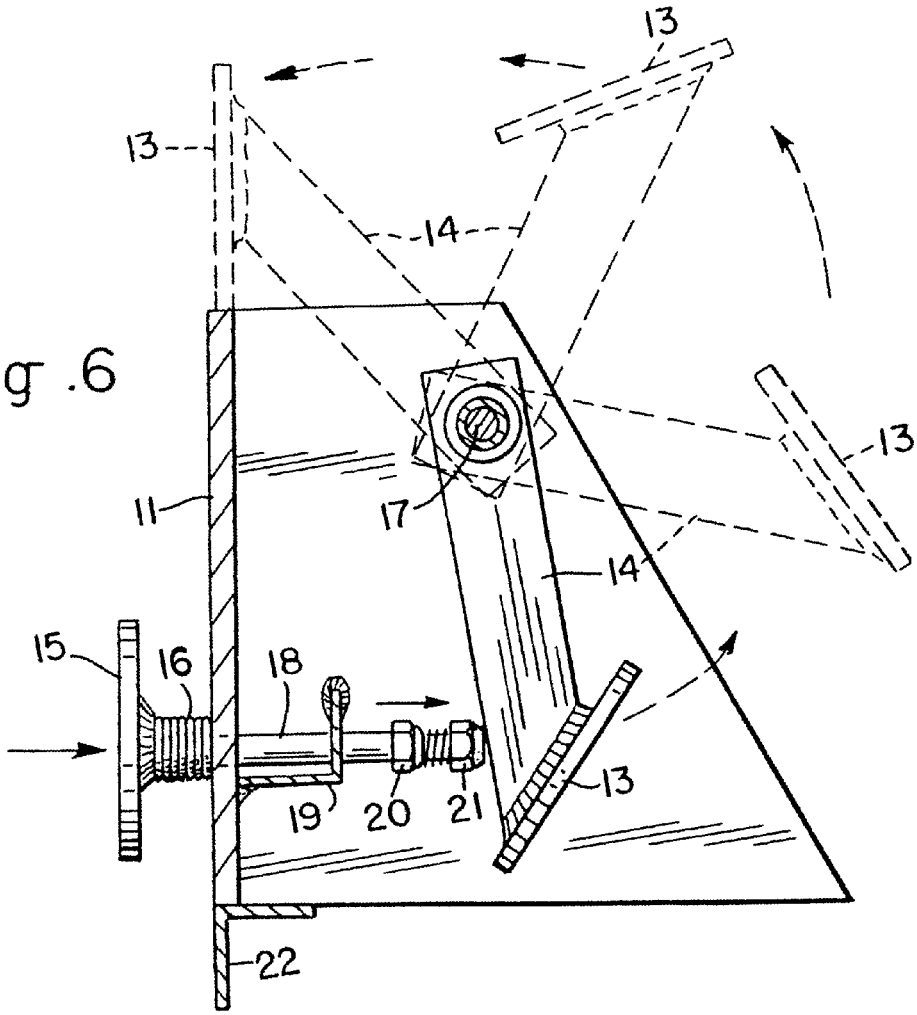

FIG. 6 is a view similar to FIG. 4 showing sequence of the reset target 15 being hit by a bullet or projectile. Reset target 15 when hit by a bullet or projectile is forced back towards faceplate 11, and reset spring 16. Threaded rod 18 slides in faceplate 11 and support angle 19, and contact nut 21 strikes stem 14 whereas said stem 14 pivots onto shaft 17 returning knockdown target 13 to the top of face plate 11, verifying that reset target 15 was hit by bullet or projectile.

What is claimed:

1. A target apparatus that comprises: said frame which houses and supports a plurality of knockdown targets with each of said knockdown targets having its own individual reset target; said plurality of said knockdown targets are designed so as to rest in a vertical position on said frame before being hit by a bullet or projectile, said knockdown targets swing backward and down upon impact of a bullet or projectile to a knockdown position inside of said frame;

a shaft being attached to sides of said frame, so as to allow said knockdown targets to swing from their vertical position said shaft having a plurality of spacers and compression springs positioned on said shaft to prevent lateral movement of said knockdown targets;

reset targets which are positioned horizontally through said frame, and positioned to be in alignment with respective said knockdown targets such that after a said reset target is hit by a bullet or projectile an associated said knockdown target returns to it's vertical position verifying said reset target was hit by a bullet or projectile, wherein a spring is used to automatically reposition said reset target.

* * * * *